US006216414B1

(12) United States Patent
Feldberg

(10) Patent No.: US 6,216,414 B1
(45) Date of Patent: Apr. 17, 2001

(54) HINGE BASE CONSTRUCTION FOR LIGHT POLES

(75) Inventor: Michael L. Feldberg, New Hope, MN (US)

(73) Assignee: Valmont-Lexington Corp, Farmington, MN (US)

( * ) Notice: Subject to any disclaimer, the term of this patent is extended or adjusted under 35 U.S.C. 154(b) by 0 days.

(21) Appl. No.: 09/261,613

(22) Filed: Mar. 1, 1999

Related U.S. Application Data

(60) Provisional application No. 60/076,350, filed on Feb. 27, 1998.

(51) Int. Cl.[7] ..... E04C 3/34

(52) U.S. Cl. ..... 52/736.1; 52/296; 52/302.5; 52/736.4; 52/169.9; 52/737.1; 248/525

(58) Field of Search ..... 52/736, 302.5, 52/736.4, 169.9, 93.1, 737.1, 737.2, 296; 248/525, 514

(56) References Cited

U.S. PATENT DOCUMENTS 3,364,635 * 1/1968 Guggemos ..... 52/296
3,630,474 * 12/1971 Minor ..... 248/158
3,671,738 * 6/1972 Beachley ..... 240/84
3,868,122 * 2/1975 Negi ..... 280/11.37 B
4,079,559 * 3/1978 Tendrummeler ..... 52/295
4,295,308 * 10/1981 Korfanta ..... 52/296
4,533,891 * 8/1985 Vanderlaan et al. ..... 335/272
4,948,083 * 8/1990 McNaney ..... 248/514
5,189,867 * 3/1993 Schmidt ..... 56/8
5,499,885 * 3/1996 Chapman ..... 403/380
5,501,048 * 3/1996 Nakanishi ..... 52/296

* cited by examiner

*Primary Examiner*—Carl D. Friedman
*Assistant Examiner*—Phi Dieu Tran A
(74) *Attorney, Agent, or Firm*—John W. Adams

(57) ABSTRACT

This is a hinge base construction for light poles which provides a non-corrosive hinge connection between the pole and the fixed base member. The connection includes non-corrosive elements to preserve the pivotal relationship between the stationary base and the pole mounting member.

4 Claims, 4 Drawing Sheets

HINGE BASE CONSTRUCTION FOR LIGHT POLES

A provisional application disclosing this invention was filed in the United States Patent and Trademark Office on Feb. 27, 1998; Provisional Application Ser. No. 60/076,350.

BACKGROUND OF THE INVENTION

Highway and parking lot light poles are mounted on a suitable concrete foundation. It is convenient to mount the pole on the hinge base assembly which permits the pole to be tilted down for servicing the light components mounted on the upper portion of the pole.

PRIOR ART

The most pertinent prior art known to applicant is the expired U.S. Pat. No. RE-26995, original U.S. Pat. No. 3,364,635, dated Jan. 23, 1968 and entitled RECESSED HINGED BASE STANDARD, issued to Kenneth F. Guggemos of Winsted, Minn., and also U.S. Pat. No. 4,079,559, issued to Bert Tendrummeler of Westminster, Calif., issued Mar. 21, 1978. Neither of these prior art patents discloses the concept of the present invention which includes the corrosive resistant construction of this invention.

SUMMARY OF THE DISCLOSURE

A concrete foundation of conventional design is provided for supporting and anchoring a pole mounted thereon. The assembly for providing a supporting base for the pole includes a stationary mounting member which is secured in fixed relation to the concrete foundation, as by suitable fixed hold down bolts with suitable leveling nuts which support and level the base on the foundation. A hinged pole-mounting platform is pivotally mounted on the supporting base as by a suitable stainless steel hinge pin supported on fixed hinge elements provided on one side of the stationery mounting member. The hinge pin provides a non-corrosive hinge connection for the tilt down movement of the pole to facilitate servicing of the elevated light elements.

A plurality of stainless steel hold down bolts are provided for securing hinged pole mounting platform to the stationary mounting member. A plurality of internally threaded non-corrosive stainless steel sleeves are integrally cast in the stationary mounting member which is anchored to the concrete base and combine with the stainless steel hold down bolts to provide a corrosion resistant anchoring system for the hinged pole mounting member and the pole mounted thereon. A suitable cover in the form of a two piece collar is provided and each of the collar sections is secured to the stationary mounting member by stainless steel hold-down screws inserted into four upstanding post elements, each of which is lined with corrosion resistant stainless steel sleeve members.

DETAILED DESCRIPTION OF THE INVENTION

A conventional concrete foundation 9 is poured into a suitable hole in the ground for supporting the light pole assembly. Suitable fixed anchoring bolts 10 are imbedded in the concrete and extend upwardly above the top thereof. A fixed base member 11 is mounted on the anchoring bolts 10 with suitable leveling nuts provided under the base member 11 and hold down nuts 10*a* are provided above the base member 11 to positively secure the same to the foundation 9.

Figure 1:
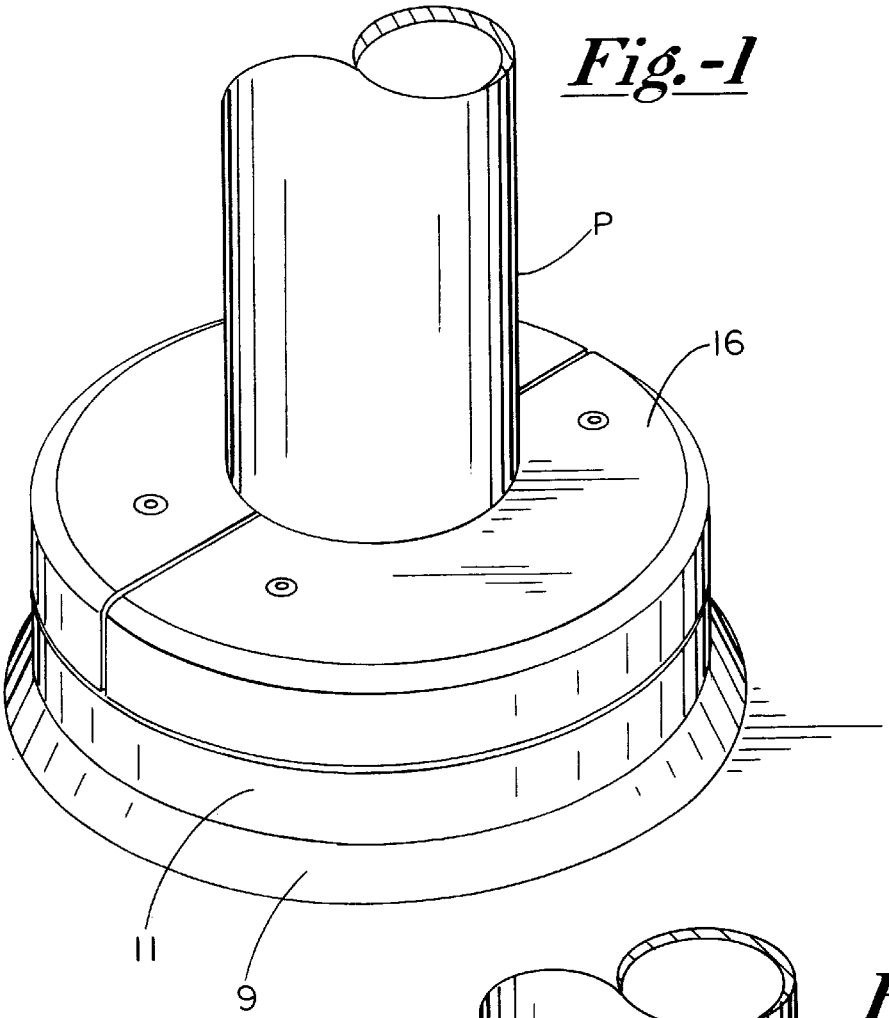
FIG. 1 is a perspective view of the pole anchoring base with the lower portion of the pole shown therein.
Figure 2:
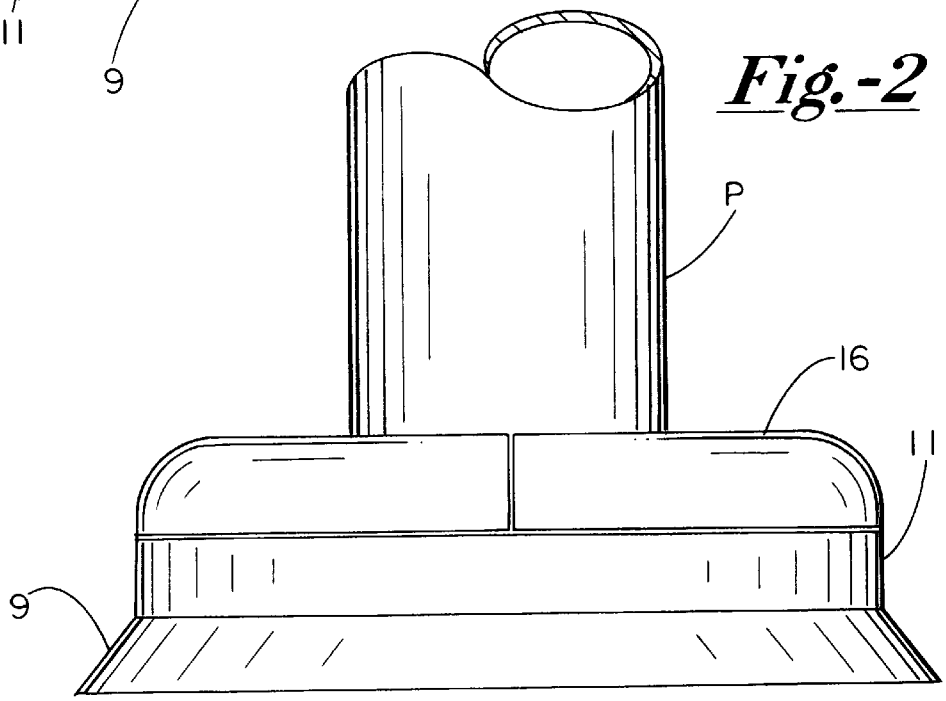
FIG. 2 is a side down elevation of the structure shown in FIG. 1.
Figure 3:
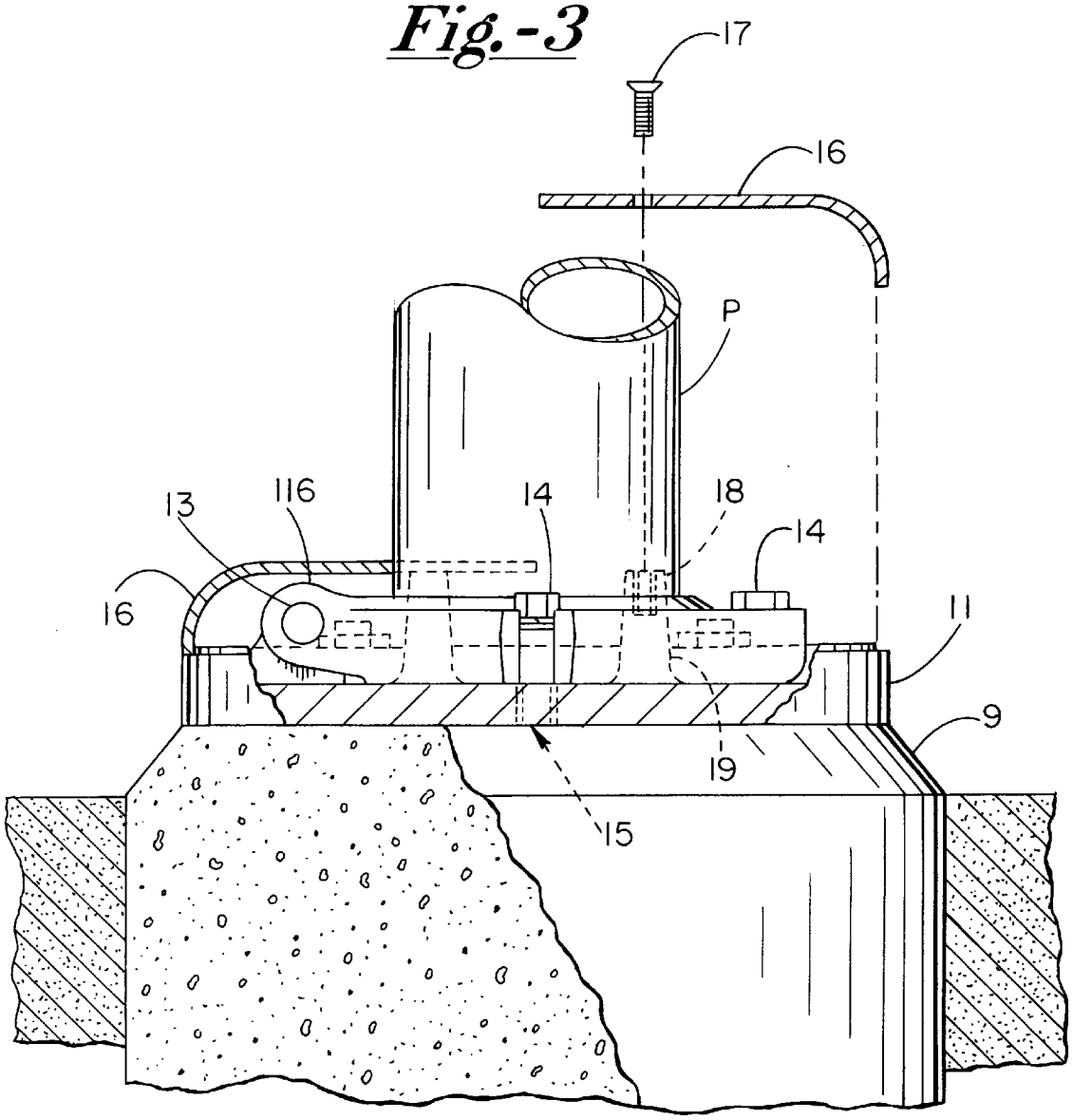
FIG. 3 is a vertical sectional view of broken away portions of the structure shown in FIG. 1.
Figure 4:
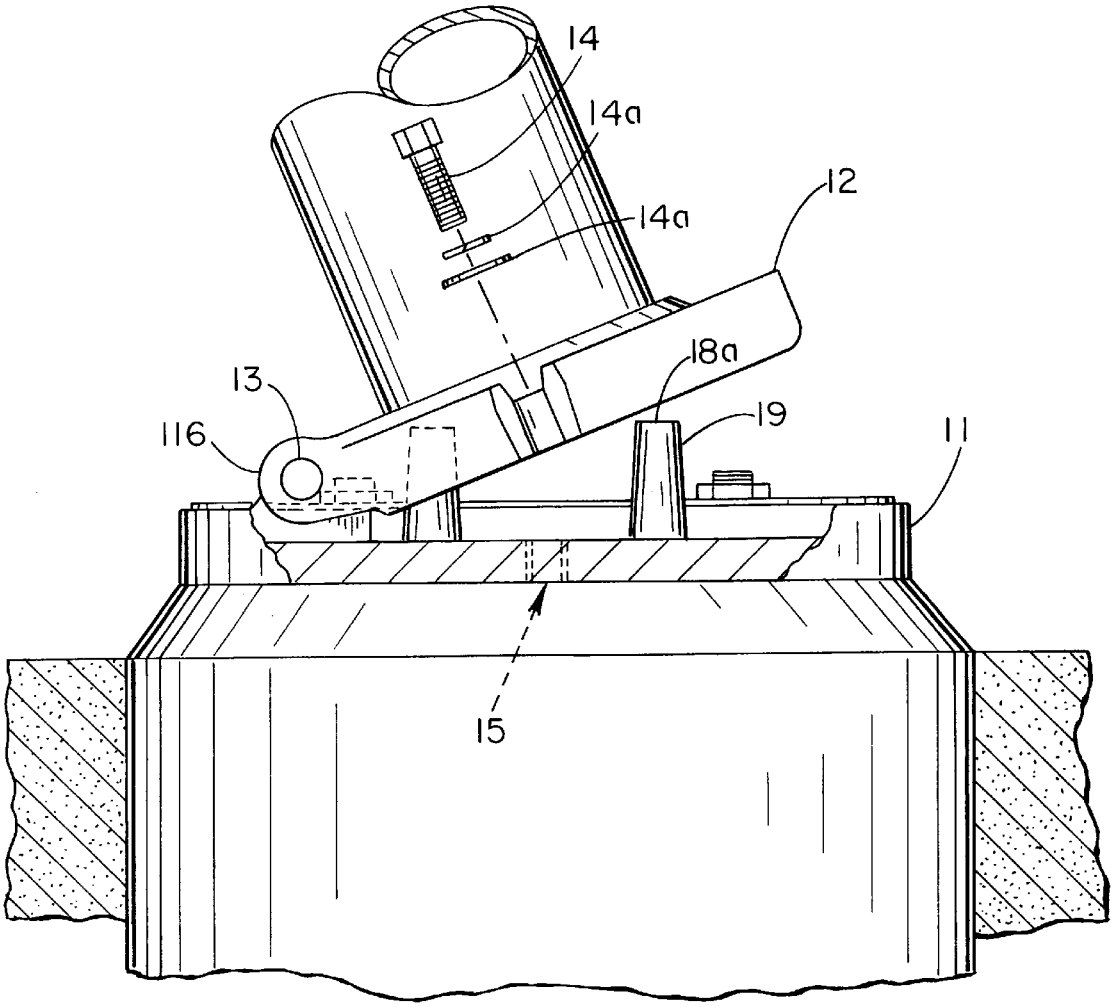
FIG. 4 is a side elevational view of the base and pole assembly in partially tilted position with portions broken away.
Figure 5:
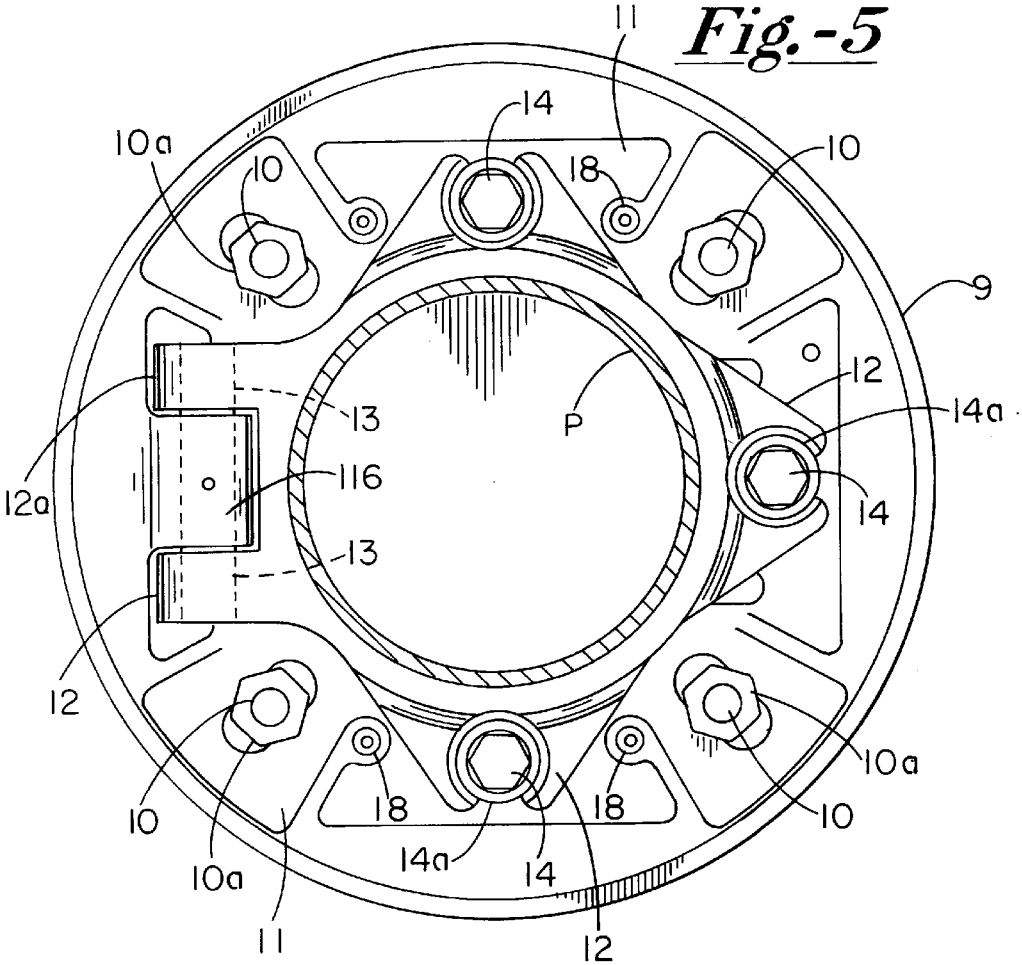
FIG. 5 is a horizontal sectional view through the pole showing the base anchoring parts in assembled position.
Figure 6:
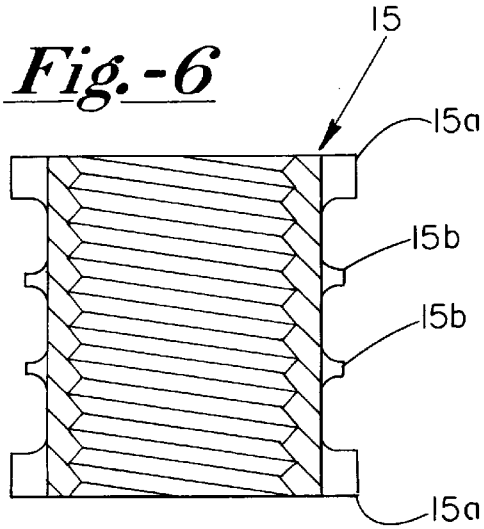
FIG. 6 is a vertical sectional view through one of the stainless steel anchoring sleeves per se.
Figure 7:
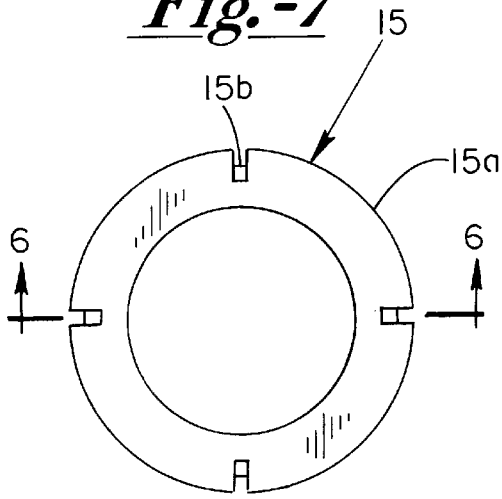
FIG. 7 is a top plan view of the anchoring sleeve shown in FIG. 6.

A hinged pole mounting and supporting platform 12 is pivotally connected to the stationary base member 11 by a stainless steel hinge pin 13 supported by a suitable fixed hinge element 11*b* provided on one side of the member 11 and connecting said fixed element 11*b* to hinge ears 12*a* of platform 12. The hinge pin 13 provides a hinge connection to facilitate the tilt down movement of the pole P shown in partially tilted position in FIG. 4. Non-corrosive hold down bolts 14 are provided for securely anchoring the hinged pole mounting member 12 to the fixed base member 11 as best shown in FIGS. 3 and 4. Suitable washers 14*a* are provided for each of the hold down bolts 14 and non-corrosive stainless steel insert sleeves 15 are cast into the base member 11 to provide the non-corrosive connection between the hinged pole mounting member 12 and the base member 11. This is an important feature of this invention as it produces an extremely durable and long-lasting hinged connection between the pole mounting member 12 and the fixed base member 11. The details of the construction of the stainless steel sleeves 15 are best shown in FIGS. 6 and 7. Each sleeve is internally threaded and has circumferential rings 15*a* formed around the upper and lower ends thereof with intermediate peripheral stabilizing rings 15*b* formed around intermediate portions of the sleeves 15 as best shown in FIG. 6. In addition to the rings 15*a* and 15*b*, the sleeves are provided with indentations or notches formed in each of the rings 15*a* as best shown in FIG. 7, which is a top plan view of a typical sleeve 15. This positively locks each of the sleeves 15 to the base member 11 and provides a rustproof joint therebetween.

A suitable cover in the form of a two-piece round collar 16 is provided. The two collar sections 16 are securely anchored to the base member 11 as by the internally threaded hold down screws 17 which are received in stainless steel sleeves 18 fixed in upstanding bases 19 integrally cast in base member 11. The sleeves 18 have exterior longitudinal ribs 18 as best shown in FIG. 4 to the base members 19 and provide rustproof connections therebetween.

It will be seen that this invention provides an extremely durable base assembly for light poles which facilitates tilting the pole down for servicing.

What is claimed is:

1. A hinge base for light poles comprising a stationary base member adapted to be mounted on the top of a suitable foundation, a plurality of threaded anchoring bolts fixed in upstanding relation to the foundation, a stationary base plate connected to said anchoring bolts and having attachment nuts for securing the plate to the anchoring bolts and foundation, a hinged pole mounting member pivotally mounted on the base plate and adapted to be fixed to the bottom of a pole mounted thereon, a plurality of hold down pole anchoring bolts connecting the pole to the base plate, a plurality of non-corrosive sleeve inserts fixed to the base plate and positioned to respectively receive the hold down pole anchoring bolts, said hold down pole anchoring bolts being readily removable without corrosion to permit the pole attached to the hinged mounting member to be tilted down for servicing the light fixture mounted thereon.

2. Structure set forth in claim 1 wherein the non-corrosive insert sleeve is provided with circumferential rings to positively lock the sleeve to the base member and provide a rustproof joint with the respective hold down bolts connected therewith.

3. The structure set forth in claim 1 and a pair of collar sections removably connected to the base member by non-corrosive sleeves and screws to permit easy removal of the cover sections.

4. The structure set forth in claim 1 and a non-corrosive pivot shaft connecting the stationary anchoring base to the pivoted pole mounting member to maintain the hinged connection between the mounting member and the fixed base member.

* * * * *